United States Patent [19]

Fleissner

[11] Patent Number: 4,620,345

[45] Date of Patent: Nov. 4, 1986

[54] APPARATUS FOR CRIMPING AND SETTING SYNTHETIC FIBER GROUPS

[75] Inventor: Heinz Fleissner, Riehen, Switzerland

[73] Assignee: Fleissner GmbH & Company, Switzerland

[21] Appl. No.: 762,502

[22] Filed: Aug. 5, 1985

Related U.S. Application Data

[63] Continuation of Ser. No. 496,258, May 19, 1983, abandoned.

[51] Int. Cl.[4] ..... D02G 1/12; D02G 1/20

[52] U.S. Cl. ..... 28/266

[58] Field of Search ..... 28/263, 264, 265, 266, 28/267, 289, 256

[56] References Cited

U.S. PATENT DOCUMENTS

| | | | |
|---|---|---|---|
| 3,341,911 | 9/1967 | Smith | 28/266 |
| 3,800,373 | 4/1974 | Fleissner . | |
| 4,118,843 | 10/1978 | Schippers et al. | 28/266 X |
| 4,301,578 | 11/1981 | Dammann et al. | 28/266 X |
| 4,422,225 | 12/1983 | Rurzke | 28/289 |

FOREIGN PATENT DOCUMENTS

| | | | |
|---|---|---|---|
| 703647 | 2/1965 | Canada | 28/266 |
| 1510248 | 10/1970 | Fed. Rep. of Germany | 28/266 |
| 2704866 | 8/1978 | Fed. Rep. of Germany | 28/289 |
| 2709680 | 9/1978 | Fed. Rep. of Germany | 28/256 |
| 145549 | 12/1980 | German Democratic Rep. | 28/266 |
| 4637007 | 10/1971 | Japan | 28/266 |
| 595634 | 12/1947 | United Kingdom | 28/263 |

*Primary Examiner*—Robert R. Mackey

*Attorney, Agent, or Firm*—Antonelli, Terry & Wands

[57] ABSTRACT

An apparatus consisting of a stuffer box crimping device of a conventional type with a cooling device immediately following thereafter and designed as a sieve drum under a suction draft. The dense crimped parcel, conducted to the sieve drum surface from the crimping chamber optionally by way of a chute is seized by the cooling air, thereupon cooled, and continuously transported. The thus set crimped structure can then be deposited without problems onto an endless belt arranged at a spacing therefrom.

3 Claims, 3 Drawing Figures

APPARATUS FOR CRIMPING AND SETTING SYNTHETIC FIBER GROUPS

Figure 1:
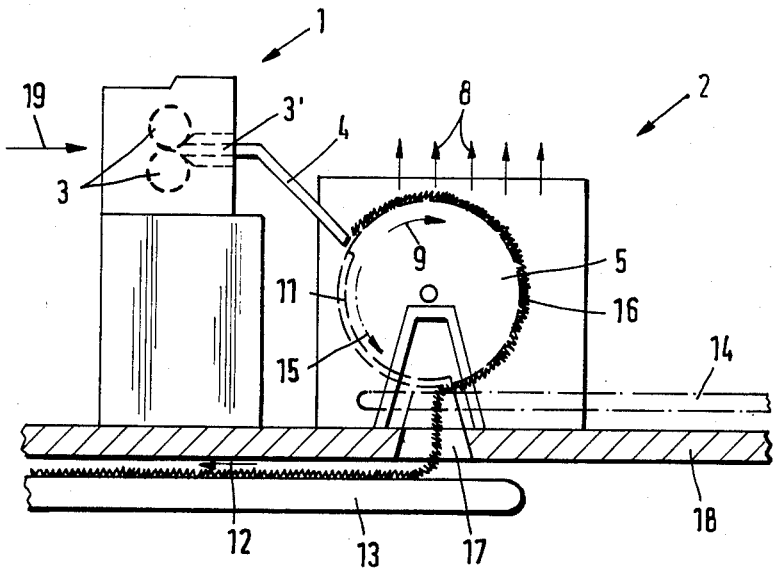

This is a continuation of application, Ser. No. 496,258, filed May 19, 1983, now abandoned.

This invention relates to an apparatus for crimping synthetic fiber groups, bundles, or strands, with a pressure roll pair and a stuffer box arranged thereafter consisting of two plates aligned with respect to the rolls, one of these plates being mounted to be pivotable, at least in part with respect to the other plate, in order to reduce the size of the chamber space, and of two lateral disks defining the chamber along its side up to the nip of the pressure rolls.

Devices of this type are known, for example, from U.S. Pat. No. 2,862,279. It is possible by means of these devices to attain a perfect crimping result on the respectively supplied synthetic fiber. In order to obtain an improved crimped structure, it is known to heat the fibers beforehand and/or to inject hot steam into the stuffer box proper, for example, according to DOS No. 2,222,124. However, this does not result in setting so that, in any event, a setting device must be arranged thereafter for a continuous operation, such as, for example, an endless belt on which the crimped strand is exposed to the setting medium.

The necessity of arranging the setting device at a certain spacing with respect to the crimping device cannot be circumvented. When transporting the crimped fiber strand, still unstabilized in the crimping effect, any longitudinal tension on the crimping must be avoided because, otherwise, an at least partial unraveling of the densely crimped structure cannot be prevented. It has been found, under practical circumstances, that this condition cannot be met either by a conveyor belt or by a chute or the like. Also, it is sometimes impossible, for reasons of available space, to set up the setting device directly after the crimping device, so that the above-mentioned danger is aggravated.

The invention is based on the object of finding a solution for the abovementioned problem. The effect to be achieved is that the still unset crimped structure of the fibers delivered from the crimping chamber can be passed on, even during further conveyance, as a clean, dense fiber parcel to a setting installation used for further processing; in this connection, the crimping, preferably, is to be treated simultaneously.

Starting with an apparatus of the type discussed above, the thus-posed problem is solved by providing that a sieve drum, traversed by cooling air from the outside toward the inside and revolving in a driven fashion, is arranged directly downstream of the stuffer box, a fan for producing the suction draft being disposed at the end face of this drum; and that a chute, or the like, is located between the transporting surface of the sieve drum, which surface is under a suction draft, and the end of the stuffer box. Thus, the idea, according to this invention, resides in setting the crimping in the hot-delivered strand with the aid of a large amount of cooling air sucked through the crimped parcel which is, simultaneously, positively and uniformly being conveyed. The solution for the abovementioned problem is attained, in particular, by ensuring, during the shock-like cooling with a sucked-through quantity of air, a simultaneous transportation of the fiber parcel. However, it is not practical to have the fiber parcel slide across a surface and cool the parcel during such step; in contrast thereto, in this arrangement the sieve drum, revolving in a driven fashion, conveys the dense fiber parcel in the direction toward an endless belt advantageously disposed thereafter, on which the crimped fibers, optionally even in turned condition, are deposited with uniform density. An even partial unraveling of the still labile crimped structure is avoided with certainty by the combination of these two devices.

Figure 2:
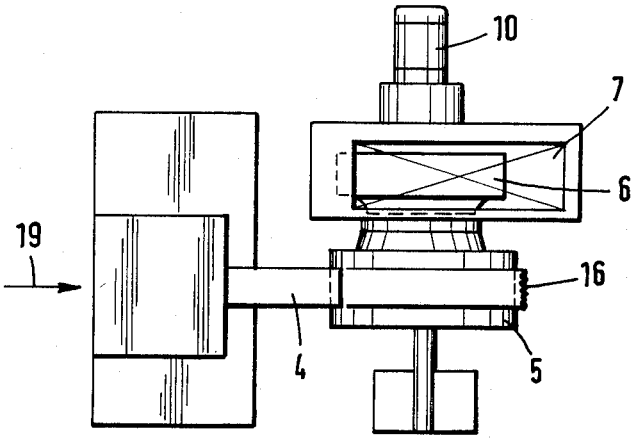
Figure 3:
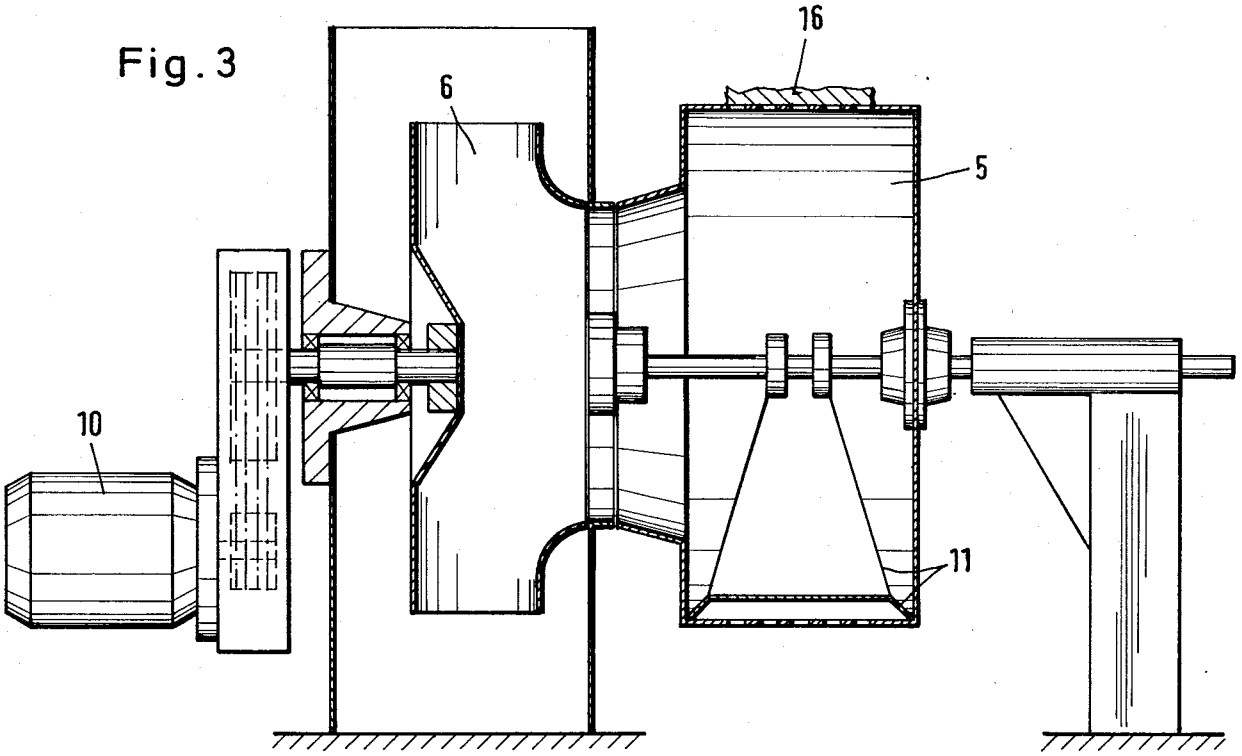

The drawing shows one embodiment of the apparatus according to the invention, to wit:

FIG. 1 shows, in a lateral view, of a series-arranged treatment installation, FIG. 2 shows a top view of the installation of FIG. 1, and FIG. 3 shows a section through cooling device of the installation of FIGS. 1 and 2.

The illustrated treatment installation includes a stuffer box crimping device generally designated by the reference numeral 1 and cooling device generally designated by the reference numeral 2. The crimping device 1 is constituted, essentially, of the pair of delivery rolls 3 with the subsequent stuffer box 3' with the upper and lower chamber plates indicated in FIG. 1. A chute 4 follows an outlet of the stuffer box 3' and, by way of the chute 4, the strand, supplied in the direction of arrow 19 and presently being in crimped form, is conducted in unchanged, dense crimping structure, without any elongation, to a sieve drum 5 under suction draft. The sieve drum 5 is traversed from outside toward the inside by ambient and, thus, cooling air. This is effected by, as shown more clearly in FIG. 2, a radial-flow fan 6 arranged at the end face with respect to the sieve drum 5. The radial-flow fan 6 is surrounded by a spiral housing 7 to remove the cooling air in the direction of arrow 8 (FIG. 1). The sieve drum 5 revolves, in a driven fashion, in the direction of arrow 9 and a drive mechanism including a drive motor 10 (not shown) serves the purpose of driving the sieve drum 5.

In the illustrated embodiment, a perforated endless belt 13 is disposed underneath the treatment installation with the belt 13 rotating in opposition to a conveying direction 19. On account of this, the sector of the sieve drum 5 located on the bottom on the left-hand side, as seen from FIG. 1, is covered by a covering 11 against the suction draft. Thus, suction draft is precluded also in the zone of the lower deflection of the sieve drum 5 and, consequently, the presently cooled synthetic fiber strand which, thus, has its crimping effect initially set, will be detached from the sieve drum 5 and will drop onto the perforated endless belt 13, rotating in the direction of arrow 12, for being transported into the setting device. This is now no longer deleterious for the crimping. If the endless belt should rotate in the direction of arrow 12', then a perforated endless belt 14 is arranged, as shown in phantom line in FIG. 1, directly below the sieve drum 5 whereupon then the sieve drum will revolve in the direction of arrow 15, whereas another portion is covered against the suction draft.

FIG. 3 shows, once again, the construction of the cooling device of FIG. 1 or 2 in a sectional view, in order to provide clarification. The radial-flow fan 6 exposes an interior of the sieve drum 5 to negative pressure, due to the suction draft produced through its revolution imparted by the motor 10, whereupon a synthetic fiber strand 16, lying on the outer surface of the sieve drum 5, is retained on the revolving sieve drum 5 and, thus, is cooled by the flowing-through ambient air in unchanged position. The cover 11 is attached to the shaft of the sieve drum 5 and can be adjusted as required in the circumferential direction. In the embodiment of FIG. 1, the set crimped strand fals through a funnel-shaped opening 17 in a bottom wall 18 to be transported away from there by means of the endless belt 13. Such an additional device 17, 18 is unnecessary if the endless belt 14 is provided.

What I claim is:

1. An apparatus for crimping synthetic fiber groups, bundles or strands, which comprises a pair of pressure rolls and a stuffer box arranged thereafter for imparting a crimp to said synthetic fiber; a vertically inclined chute for transporting hot crimped fiber discharged from said stuffer box downwardly and forwardly by gravity; a sieve drum for setting the crimp imparted to said synthetic fiber, traversed by cooling air from an outside thereof toward the inside and revolving in a driven fashion, said sieve drum being arranged downstream of and below the stuffer box; a fan for producing a suction draft disposed at an end face of the sieve drum; said vertically inclined chute being arranged between a transporting surface of the sieve drum, which surface is under the suction draft, and a discharge end of the stuffer box; the crimped fiber displaced from the stuffer box being immediately transported down the vertically inclined chute and thereafter laid in a still dense crimped structure on the sieve drum and the fan drawing cooling air through said crimped structure to set the crimp thereon by shock-like cooling; unravelling of the still labile crimped structure being prevented due to the arrangement of the inclined chute and the sieve drum; and an endless belt for transporting of the set, crimped fiber to a further treatment in the same direction of travel as the crimped fiber on the rotary sieve drum, said belt being arranged immediately underneath the sieve drum whereby the set, crimped fiber is directly dropped onto the endless belt without disturbing the dense crimped structure of the crimped fiber.

2. An apparatus according to claim 1, wherein a zone of the sieve drum, not covered by crimped fiber strand, is covered by an internal covering.

3. An apparatus according to claim 1, wherein the further treatment of said crimped fiber is effected by means for setting the fiber by the application of heat.

* * * * *